US009451830B1

(12) United States Patent
Buzzella et al.

(10) Patent No.: US 9,451,830 B1
(45) Date of Patent: Sep. 27, 2016

(54) RETROFITTING CANOPY ASSEMBLY FOR A CHAIR AND METHODS OF MANUFACTURING SAME

(71) Applicant: Pavilion Furniture, Inc., Miami, FL (US)

(72) Inventors: Michael Buzzella, Davie, FL (US); Armando Bustamante, Hialeah, FL (US); Juan Quintana Cruz, Miami, FL (US)

(73) Assignee: Pavilion Furniture, Inc., Miami, FL (US)

( * ) Notice: Subject to any disclaimer, the term of this patent is extended or adjusted under 35 U.S.C. 154(b) by 0 days.

(21) Appl. No.: 14/731,185

(22) Filed: Jun. 4, 2015

(51) Int. Cl.
*A47C 7/66* (2006.01)
*E04H 15/48* (2006.01)
*E04H 15/02* (2006.01)

(52) U.S. Cl.
CPC ..... *A47C 7/66* (2013.01); *E04H 15/02* (2013.01); *E04H 15/48* (2013.01)

(58) Field of Classification Search
CPC ..... A47C 7/66
USPC ..... 135/96; 297/184.15, 184.11
See application file for complete search history.

(56) References Cited

U.S. PATENT DOCUMENTS 4,687,249 A 8/1987 Mills
4,809,724 A * 3/1989 Fuser ..... A45B 11/00 135/16
5,013,085 A 5/1991 Craig
5,080,432 A 1/1992 Connell
5,092,653 A 3/1992 Felling
5,515,564 A * 5/1996 Lyons ..... A47C 1/14 190/1
5,593,205 A * 1/1997 Vanderminden, Sr. .. A47C 7/66 135/96
5,695,100 A * 12/1997 O'Brien ..... A47C 7/66 135/143
5,921,258 A * 7/1999 Francois ..... A47C 7/66 135/117
6,520,574 B1 * 2/2003 Huang ..... A47C 7/66 248/515
6,789,557 B1 * 9/2004 Wahl, Jr. ..... A47C 7/66 135/117
7,243,990 B1 * 7/2007 Wahl ..... A47C 7/66 297/184.15
7,431,389 B2 10/2008 Reeb et al.
7,566,095 B2 7/2009 Reeb et al.
7,585,020 B1 * 9/2009 Wahl, Jr. ..... A47C 7/66 297/184.15
7,815,254 B2 10/2010 Reeb et al.
7,909,395 B2 3/2011 Reeb et al.
7,963,596 B2 6/2011 Efthimiou
8,070,220 B2 12/2011 Reeb et al.
8,186,755 B2 * 5/2012 Lovley ..... A47C 7/66 135/119

(Continued)

FOREIGN PATENT DOCUMENTS

EP 0528814 B1 5/1997

*Primary Examiner* — Noah Chandler Hawk
(74) *Attorney, Agent, or Firm* — Mayback & Hoffman, P.A.; Gregory L. Mayback

(57) ABSTRACT

A retrofitting canopy assembly includes a housing defining an interior and first and second openings communicating from the interior to the environment and, together, shaped to receive a top portion of a chair frame when slid thereon, washers, a canopy frame, a ratchet part rotationally fixed to the canopy frame, another ratchet part rotationally fixed to the housing, a frame lock within the housing and movable to secure the housing on the chair frame, and a fastener securing the canopy frame to the first and second ratchet parts, the housing, the frame lock, and washers such that, when the housing is placed on the top of the chair frame, the canopy ratchet parts remain rotationally fixed to one other to keep the shade canopy in a given position until a force sufficient to overcome the ratchet is applied to the canopy frame and/or the shade canopy.

18 Claims, 17 Drawing Sheets

(56) References Cited

U.S. PATENT DOCUMENTS

| | | | | |
|---|---|---|---|---|
| 8,210,193 | B2 * | 7/2012 | Ortiz | A45B 11/00 135/88.04 |
| 8,439,055 | B2 * | 5/2013 | April | A45B 11/00 135/16 |
| 8,517,465 | B2 | 8/2013 | Reeb et al. | |
| 2010/0045081 | A1 * | 2/2010 | Efthimiou | A47C 7/66 297/184.11 |
| 2014/0167458 | A1 | 6/2014 | Reeb et al. | |
| 2014/0306494 | A1 * | 10/2014 | Frankel | A47C 7/66 297/184.15 |

* cited by examiner

RETROFITTING CANOPY ASSEMBLY FOR A CHAIR AND METHODS OF MANUFACTURING SAME

FIELD OF THE INVENTION

The present systems and methods lies in the field of canopy assemblies. The present disclosure relates to a retrofitting canopy assembly for a chair and methods for manufacturing such a canopy assembly.

BACKGROUND OF THE INVENTION

Attempts have been made to provide canopied seating in various configurations. However, these attempts have either produced seating having a permanent "built-in" canopy or temporary canopy attachments that are not sturdy. Presently, there is no temporary canopy that is adjustable and can be fitted securely to a chair.

Thus, a need exists to overcome the problems with the prior art systems, designs, and processes as discussed above.

SUMMARY OF THE INVENTION

The systems and methods described provide a canopy that overcome(s) the hereinafore-mentioned disadvantages of the heretofore-known devices and methods of this general type and that provide such features with a canopy assembly.

With the foregoing and other objects in view, there is provided, a retrofitting canopy assembly includes a canopy sling rail housing defining an interior and first and second openings communicating from the interior to the environment and, together, are shaped to receive a top portion of a sling-back-type chair frame when the canopy sling rail housing is slid thereon to place the top portion within the interior, a plurality of washers, a canopy frame having a connection section and a shade canopy, a first canopy ratchet part rotationally fixed to the connection section of the canopy frame, a second canopy ratchet part rotationally fixed to the canopy sling rail housing, a frame lock positioned within the interior of the canopy sling rail housing and movable to selectively press against the top portion of the sling-back-type chair frame when the canopy sling rail housing is installed thereon, and a fastener securing the connection section of the canopy frame to the first canopy ratchet part, the second canopy ratchet part, the canopy sling rail housing, the frame lock, and the plurality of washers such that, when the canopy sling rail housing is placed on the top portion of the sling-back-type chair frame, the first and second canopy ratchet parts remain rotationally fixed to one other to keep the shade canopy in a given position until a given force sufficient to overcome the ratchet is applied to at least one of the canopy frame and the shade canopy.

In accordance with another feature, the canopy sling rail housing, the plurality of washers, the first and second canopy ratchet parts, the frame lock, and the fastener is a first housing sub-assembly and further comprising a second housing sub-assembly that is a mirror image of the first housing sub-assembly and the two housing sub-assemblies respectively fit over opposing top portions of the sling-back-type chair frame to place the shade canopy over the sling-back-type chair and provide shade to a user in an adjustable manner.

In accordance with a further feature, the fastener removably secures the connection section of the canopy frame to the first canopy ratchet part, the second canopy ratchet part, the canopy sling rail housing, the frame lock, and the plurality of washers.

In accordance with an added feature, the connection section of canopy frame has a transverse opening, the first and second canopy ratchet parts have a coaxial central openings, the canopy sling rail housing has a transverse opening pair, the frame lock has a transverse opening, the plurality of washers each have a coaxial central opening, and the fastener is a single screw passing through, in order, the transverse opening, the coaxial central openings, a first of the transverse opening pair, the transverse opening, the second of the transverse opening pair, and the coaxial central openings, and the canopy frame, the first and second ratchet parts, the canopy sling rail housing, the frame lock, and the washers are fastened together with a locking nut to permit the first and second canopy ratchet parts to remain rotationally fixed to one other and keep the shade canopy in a given position until a given force sufficient to overcome the ratchet is applied to at least one of the canopy frame and the shade canopy.

In accordance with an additional feature, there is provided a thumb screw cooperating with the canopy sling rail housing to selectively move the frame lock towards and away from the top portion of the sling-back-type chair frame when the canopy sling rail housing is installed thereon.

In accordance with yet another feature, the frame lock and the thumb screw removably secure the canopy sling rail housing to the top portion of the sling-back-type chair frame.

In accordance with yet a further feature, the first canopy ratchet part has a plurality of first circumferentially spaced ridges defining a plurality of first trenches between each adjacent pair of the plurality of first circumferentially spaced ridges and the second canopy ratchet part has a plurality of second circumferentially spaced ridges defining a plurality of second trenches between each adjacent pair of the plurality of second circumferentially spaced ridges.

In accordance with yet an added feature, the second circumferentially spaced ridges are a mirror image of the first circumferentially spaced ridges such that, when the first and second circumferentially spaced ridges are meshed together, a ratchet assembly is formed.

In accordance with yet an additional feature, the plurality of first circumferentially spaced ridges are shaped to fit into the plurality of second trenches, the plurality of second circumferentially spaced ridges are shaped fit into the plurality of first trenches, and, when the first and second circumferentially spaced ridges are fit into the respective first and second trenches, the first and second canopy ratchet parts together form a ratchet assembly.

In accordance with again another feature, the plurality of washers comprise a pair of non-elastic washers sandwiching therebetween a pair of elastic washers.

In accordance with again a further feature, the fastener has a longitudinal axis, the plurality of washers together permit displacement along the longitudinal axis of the fastener, and radial adjustment of the first and second ratchet parts is accomplished by rotating the plurality of first radial ridges and second radial ridges to an adjacent trench with the displacement of the washers along the longitudinal axis.

In accordance with again an added feature, the connection section defines at least one first orifice, a first canopy ratchet part has at least one projection that, when inserted into the at least one first orifice, rotationally fixes the first canopy ratchet part to the connection section of the canopy frame, the canopy sling rail housing defines at least one second orifice, and the second canopy ratchet part has at least one projection that, when inserted into the at least one second orifice, rotationally fixes the second canopy ratchet part to the canopy sling rail housing.

With the objects in view, there is also provided a retrofitting canopy assembly includes a canopy frame having a first connection section, a second connection section, and a shade canopy, and first and second housing sub-assemblies. The first housing sub-assembly comprises a first canopy sling rail housing defining a first housing interior and first and second openings communicating from the first housing interior to the environment and, together, are shaped to receive a top left portion of a sling-back-type chair frame when the first canopy sling rail housing is slid thereon to place the top left portion within the first housing interior, a first plurality of washers, a first canopy ratchet part rotationally fixed to the first connection section of the canopy frame, a second canopy ratchet part rotationally fixed to the first canopy sling rail housing, a first frame lock positioned within the first housing interior and movable to selectively press against the top left portion of the sling-back-type chair frame when the first canopy sling rail housing is installed thereon, and a first fastener securing the first connection section of the canopy frame to the first canopy ratchet part, the second canopy ratchet part, the first canopy sling rail housing, the first frame lock, and the first plurality of washers such that, when the first canopy sling rail housing is placed on the top left portion of the sling-back-type chair frame, the first and second canopy ratchet parts remain rotationally fixed to one other to keep the shade canopy in a given position until a given force sufficient to overcome the ratchet is applied to at least one of the canopy frame and the shade canopy. The second housing sub-assembly comprises a second canopy sling rail housing defining a second housing interior and third and fourth openings communicating from the second housing interior to the environment and, together, are shaped to receive a top right portion of a sling-back-type chair frame when the second canopy sling rail housing is slid thereon to place the top right portion within the second housing interior, a second plurality of washers, a third canopy ratchet part rotationally fixed to the second connection section of the canopy frame, a fourth canopy ratchet part rotationally fixed to the second canopy sling rail housing, a second frame lock positioned within the second housing interior and movable to selectively press against the top right portion of the sling-back-type chair frame when the second canopy sling rail housing is installed thereon, and a second fastener securing the second connection section of the canopy frame to the third canopy ratchet part, the fourth canopy ratchet part, the second canopy sling rail housing, the second frame lock, and the second plurality of washers such that, when the second canopy sling rail housing is placed on the top right portion of the sling-back-type chair frame, the third and fourth canopy ratchet parts remain rotationally fixed to one other to keep the shade canopy in a given position until a given force sufficient to overcome the ratchet is applied to at least one of the canopy frame and the shade canopy.

In accordance with again an additional feature, there are provided thumb screws each respectively cooperating with one of the first and second canopy sling rail housings to selectively move the respective one of first and second frame locks towards and away from the top left or right portions of the sling-back-type chair frame when the first and second canopy sling rail housings are installed thereon.

In accordance with still another feature, each respective pair of the frame locks and the thumb screws removably secure one of the first and second canopy sling rail housings to one of the top left or right portions of the sling-back-type chair frame.

In accordance with still a further feature, the first canopy ratchet part has a plurality of first circumferentially spaced ridges defining a plurality of first trenches between each adjacent pair of the plurality of first circumferentially spaced ridges, the second canopy ratchet part has a plurality of second circumferentially spaced ridges defining a plurality of second trenches between each adjacent pair of the plurality of second circumferentially spaced ridges, the third canopy ratchet part has a plurality of third circumferentially spaced ridges defining a plurality of third trenches between each adjacent pair of the plurality of third circumferentially spaced ridges, and the fourth canopy ratchet part has a plurality of fourth circumferentially spaced ridges defining a plurality of fourth trenches between each adjacent pair of the plurality of fourth circumferentially spaced ridges.

In accordance with still an added feature, the second circumferentially spaced ridges are a mirror image of the first circumferentially spaced ridges such that, when the first and second circumferentially spaced ridges are meshed together, a ratchet assembly is formed and the fourth circumferentially spaced ridges are a mirror image of the third circumferentially spaced ridges such that, when the third and fourth circumferentially spaced ridges are meshed together, a ratchet assembly is formed.

In accordance with still an additional feature, the plurality of first circumferentially spaced ridges are shaped to fit into the plurality of second trenches, the plurality of second circumferentially spaced ridges are shaped fit into the plurality of first trenches, the plurality of third circumferentially spaced ridges are shaped to fit into the plurality of fourth trenches, the plurality of fourth circumferentially spaced ridges are shaped fit into the plurality of third trenches, and, when the third and fourth circumferentially spaced ridges are fit into the respective third and fourth trenches, the third and fourth canopy ratchet parts together form a ratchet assembly.

In accordance with an additional feature, the first and second plurality of washers each comprise a pair of non-elastic washers sandwiching therebetween a pair of elastic washers, each of the first and second fasteners has a longitudinal axis, the sets of the first and second plurality of washers each permit displacement along the longitudinal axis of the respective first and second fasteners, and radial adjustment of the first and second ratchet parts and the third and fourth ratchet parts is accomplished by respectively rotating the plurality of first radial ridges and second radial ridges to an adjacent trench with the displacement of the washers along the longitudinal axis and rotating the plurality of third radial ridges and fourth radial ridges to an adjacent trench with the displacement of the sets of washers along the longitudinal axis.

In accordance with a concomitant feature, the first connection section defines at least one first orifice, a first canopy ratchet part has at least one projection that, when inserted into the at least one first orifice, rotationally fixes the first canopy ratchet part to the first connection section of the canopy frame, the first canopy sling rail housing defines at least one second orifice, the second canopy ratchet part has at least one projection that, when inserted into the at least one second orifice, rotationally fixes the second canopy ratchet part to the first canopy sling rail housing, the second connection section defines at least one third orifice, a third canopy ratchet part has at least one projection that, when inserted into the at least one third orifice, rotationally fixes the third canopy ratchet part to the second connection section of the canopy frame, the second canopy sling rail housing defines at least one fourth orifice, and the fourth canopy ratchet part has at least one projection that, when inserted into the at least one fourth orifice, rotationally fixes the fourth canopy ratchet part to the second canopy sling rail housing.

Although the systems and methods are illustrated and described herein as embodied in a retrofitting canopy assembly for a chair and methods of manufacturing same, it is, nevertheless, not intended to be limited to the details shown because various modifications and structural changes may be made therein without departing from the spirit of the invention and within the scope and range of equivalents of the claims. Additionally, well-known elements of exemplary embodiments will not be described in detail or will be omitted so as not to obscure the relevant details of the systems and methods.

Additional advantages and other features characteristic of the systems and methods will be set forth in the detailed description that follows and may be apparent from the detailed description or may be learned by practice of exemplary embodiments. Still other advantages of the systems and methods may be realized by any of the instrumentalities, methods, or combinations particularly pointed out in the claims.

Other features that are considered as characteristic for the systems and methods are set forth in the appended claims. As required, detailed embodiments of the systems and methods are disclosed herein; however, it is to be understood that the disclosed embodiments are merely exemplary of the systems and methods, which can be embodied in various forms. Therefore, specific structural and functional details disclosed herein are not to be interpreted as limiting, but merely as a basis for the claims and as a representative basis for teaching one of ordinary skill in the art to variously employ the systems and methods in virtually any appropriately detailed structure. Further, the terms and phrases used herein are not intended to be limiting; but rather, to provide an understandable description of the systems and methods. While the specification concludes with claims defining the systems and methods of the invention that are regarded as novel, it is believed that the systems and methods will be better understood from a consideration of the following description in conjunction with the drawing figures, in which like reference numerals are carried forward.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages all in accordance with the systems and methods. Advantages of embodiments of the systems and methods will be apparent from the following detailed description of the exemplary embodiments thereof, which description should be considered in conjunction with the accompanying drawings in which.

DETAILED DESCRIPTION OF THE INVENTION

Figure 1:
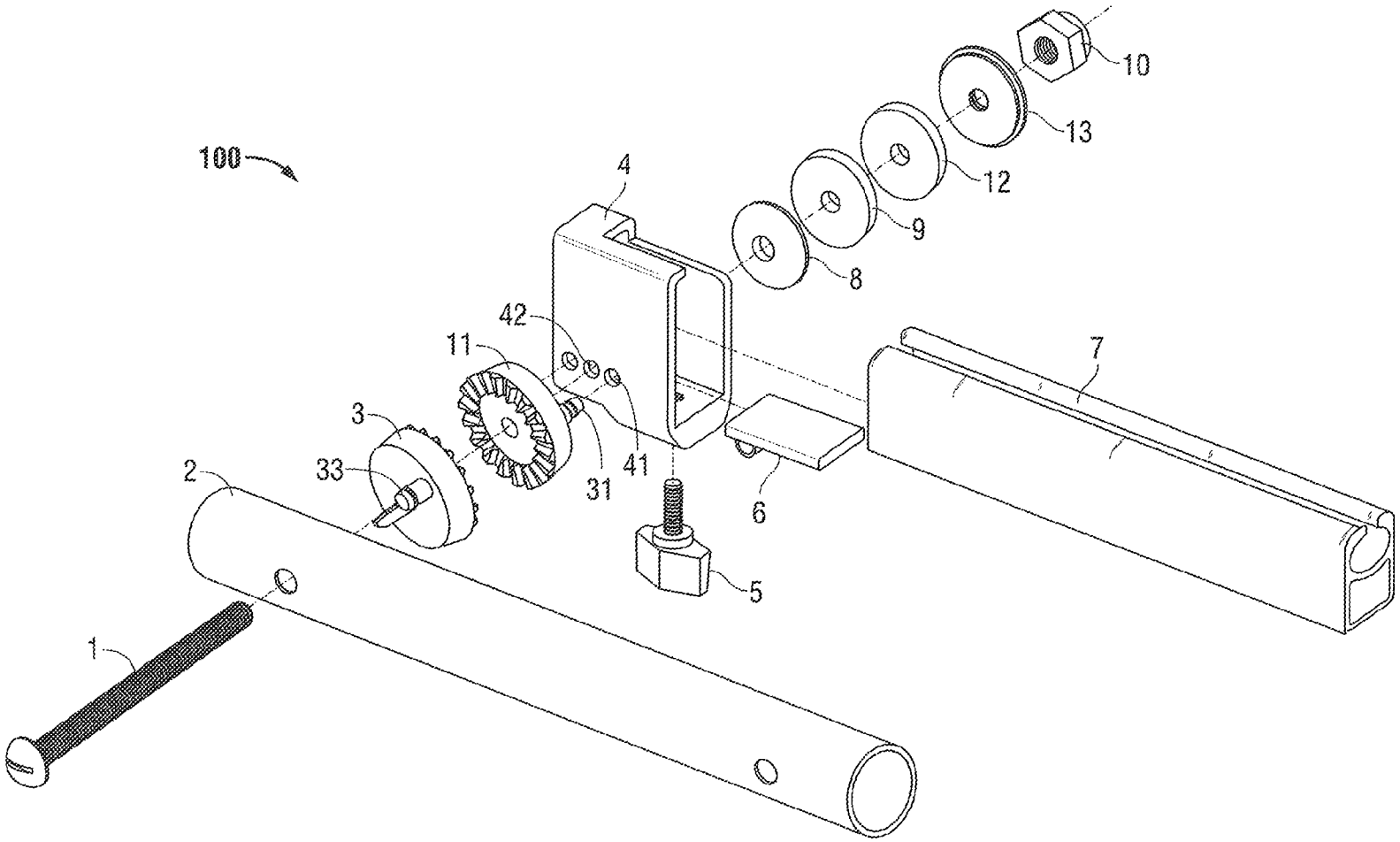
FIG. 1 is an exploded, perspective view of a first half of exemplary embodiment of a canopy assembly.

As required, detailed embodiments of the systems and methods are disclosed herein; however, it is to be understood that the disclosed embodiments are merely exemplary of the systems and methods, which can be embodied in various forms. Therefore, specific structural and functional details disclosed herein are not to be interpreted as limiting, but merely as a basis for the claims and as a representative basis for teaching one skilled in the art to variously employ the systems and methods in virtually any appropriately detailed structure. Further, the terms and phrases used herein are not intended to be limiting; but rather, to provide an understandable description of the systems and methods. While the specification concludes with claims defining the features of the systems and methods that are regarded as novel, it is believed that the systems and methods will be better understood from a consideration of the following description in conjunction with the drawing figures, in which like reference numerals are carried forward.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Alternate embodiments may be devised without departing from the spirit or the scope of the invention. Additionally, well-known elements of exemplary embodiments of the systems and methods will not be described in detail or will be omitted so as not to obscure the relevant details of the systems and methods.

Before the systems and methods are disclosed and described, it is to be understood that the terminology used herein is for the purpose of describing particular embodiments only and is not intended to be limiting. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element. The terms "including" and/or "having," as used herein, are defined as comprising (i.e., open language). The terms "a" or "an", as used herein, are defined as one or more than one. The term "plurality," as used herein, is defined as two or more than two. The term "another," as used herein, is defined as at least a second or more. The description may use the terms "embodiment" or "embodiments," which may each refer to one or more of the same or different embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact (e.g., directly coupled). However, "coupled" may also mean that two or more elements are not in direct contact with each other, but yet still cooperate or interact with each other (e.g., indirectly coupled).

For the purposes of the description, a phrase in the form "A/B" or in the form "A and/or B" or in the form "at least one of A and B" means (A), (B), or (A and B), where A and B are variables indicating a particular object or attribute. When used, this phrase is intended to and is hereby defined as a choice of A or B or both A and B, which is similar to the phrase "and/or". Where more than two variables are present in such a phrase, this phrase is hereby defined as including only one of the variables, any one of the variables, any combination of any of the variables, and all of the variables, for example, a phrase in the form "at least one of A, B, and C" means (A), (B), (C), (A and B), (A and C), (B and C), or (A, B and C).

Relational terms such as first and second, top and bottom, and the like may be used solely to distinguish one entity or action from another entity or action without necessarily requiring or implying any actual such relationship or order between such entities or actions. The description may use perspective-based descriptions such as up/down, back/front, and top/bottom. Such descriptions are merely used to facilitate the discussion and are not intended to restrict the application of disclosed embodiments. Various operations may be described as multiple discrete operations in turn, in a manner that may be helpful in understanding embodiments; however, the order of description should not be construed to imply that these operations are order dependent.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Herein various embodiments of the systems and methods are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

Described now are exemplary embodiments. Referring now to the figures of the drawings in detail and first, particularly to FIG. 1, there is shown a first exemplary embodiment of a canopy assembly. The canopy assemblies of the present disclosure can be described as retrofitting canopy assemblies that can be attached to a sling-back style chair or any other chair capable of being used with the presently disclosed canopy assemblies. In an alternative embodiment, the canopy can fit over the poles of the back of any chair. The poles can be cylindrical, cubic, etc., and the canopy assembly can be attached to whatever shaped poles are present.

FIG. 1 is an exploded view of a canopy assembly 100 according to one exemplary embodiment. Canopy assembly 100 that is shown is a canopy assembly 100 that is attached to a right side of a chair. A similar, mirror-imaged canopy assembly 200 is to be attached to a left side of a chair and is shown in the exploded view of FIG. 2. The elements of canopy assemblies 100, 200 are the same except for the shape of the canopy sling rail housing 14, which is to be attached to a left side of a chair.

Figure 2:
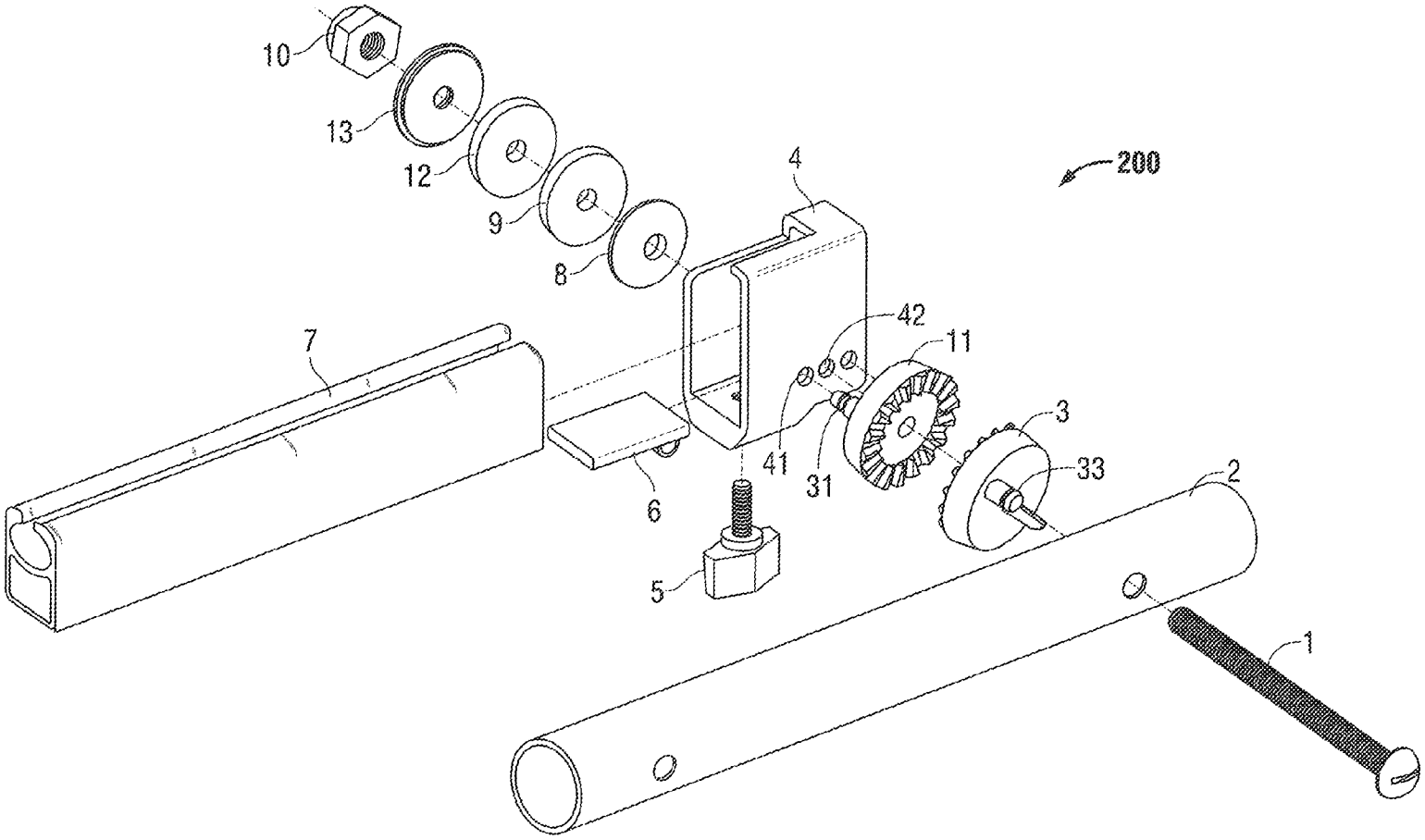
FIG. 2 is an exploded, perspective view of a second half of the canopy assembly of FIG. 1.
Figure 5:
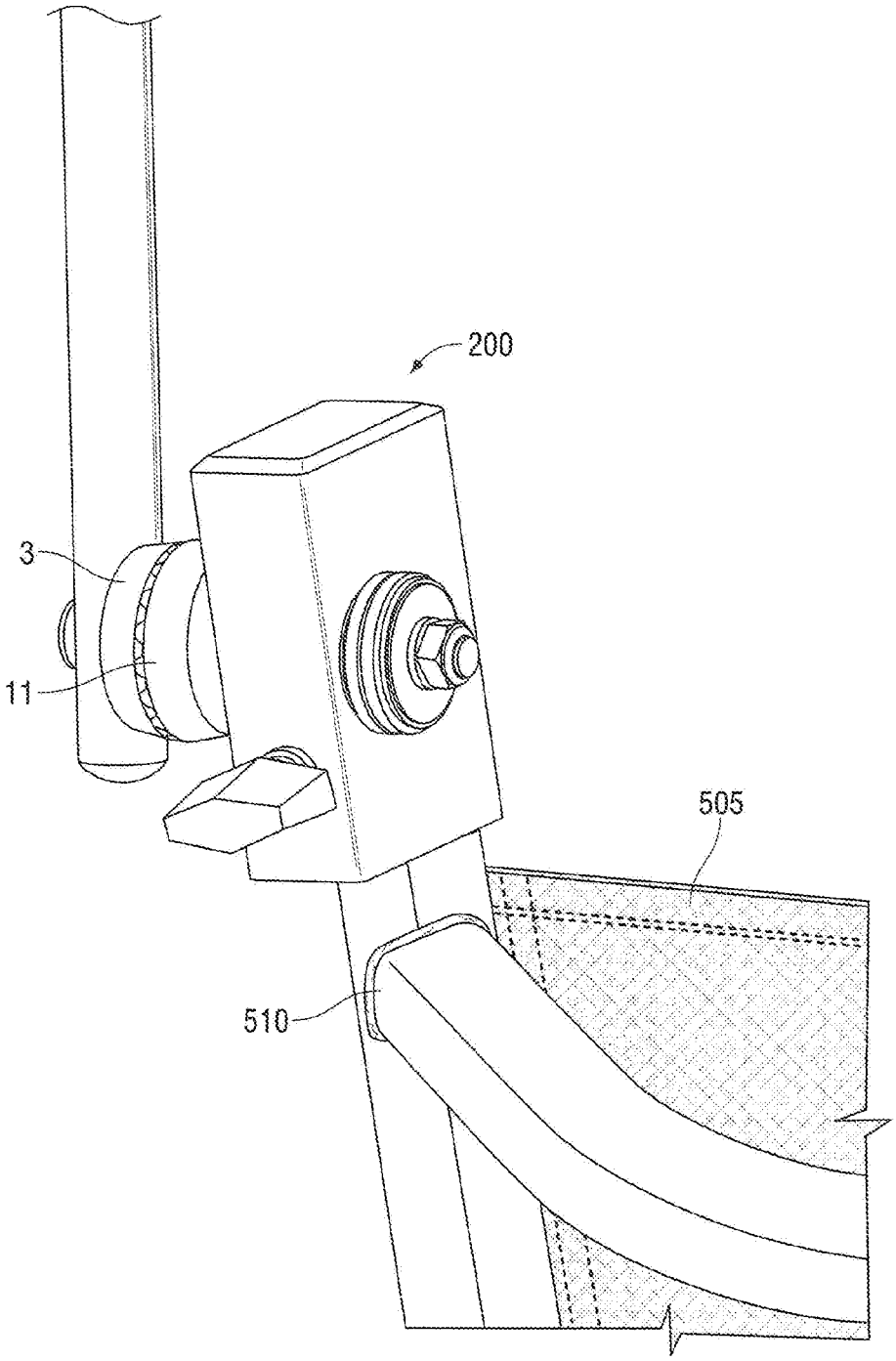
FIG. 5 is a photograph showing a back view of a left side canopy assembly of FIG. 2.
Figure 6:
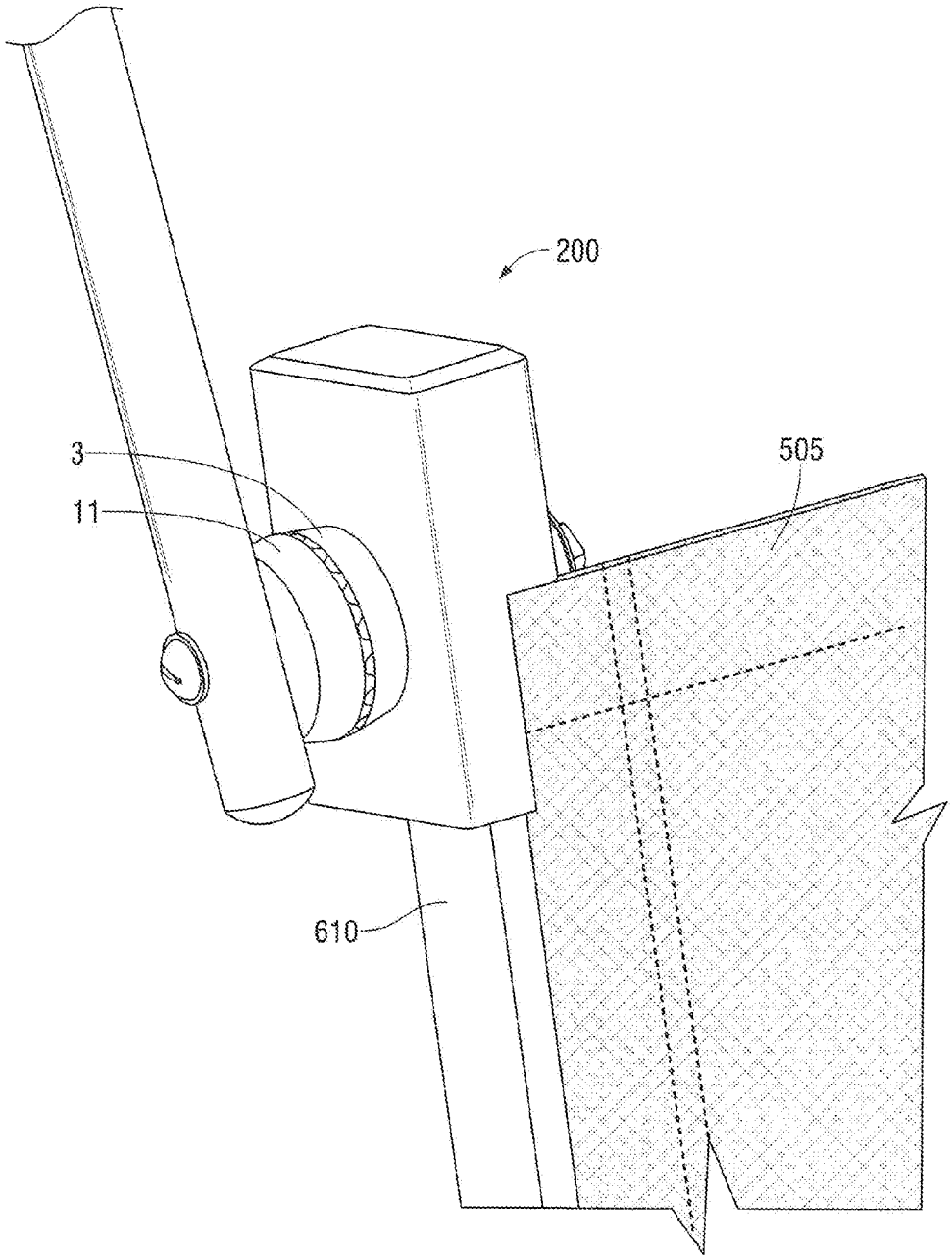
FIG. 6 is a photograph showing a front view of a right side canopy assembly of FIG. 1.

The canopy assembly 100 includes a fastener 1 (e.g., a screw), a canopy frame 2 (only a portion of the canopy is shown), two canopy ratchet parts 3, 11, a canopy sling rail housing 4, a thumb screw 5, a frame lock 6, two non-elastic washers 8, 13 (e.g., metal washers), two elastic washers 9, 12, and a locking nut 10. A portion of a sling-rail chair frame 7 is shown for illustrative purposes. As used herein, non-elastic means that the material is substantially incompressible and elastic means that the material is compressible. Therefore, the non-elastic washers 8, 13 can be, e.g., of metal, such as stainless steel, aluminum, and nickel, and the elastic washers can be, e.g., of rubber or plastic. The portion of the canopy frame 2 that is shown in FIGS. 1 and 2 can be a lower canopy frame part, which is depicted, or the portion can be the entirety of the canopy frame, which is depicted in FIGS. 5 and 6.

In one exemplary embodiment, the screw 1 has a size of ¼"-20×3½" (i.e., the screw has a gauge of ¼" inch, 20 threads per inch, and a length of 3½" inches). In one exemplary embodiment, locking nut 10 is a stainless steel nut with a nylon lock nut. In one exemplary embodiment, the flexible washers 9, 12 are rubber washers but they can also be of neoprene. In one exemplary embodiment, metal washers 8, 13 are stainless steel and neoprene washer assemblies.

To assemble the canopy assembly 100, the screw 1 is passed through (in order): the canopy frame 2; a first canopy ratchet part 3; a second canopy ratchet part 11; the canopy sling rail housing 4; the frame lock 6; a first metal washer 8; a first rubber washer 9; a second rubber washer 12; and a second metal washer 13. The locking nut 10 is rotated along the threads of the screw to tighten elements 2, 3, 4, 6, 8, 9, 11, 12, and 13 together.

Figure 3:
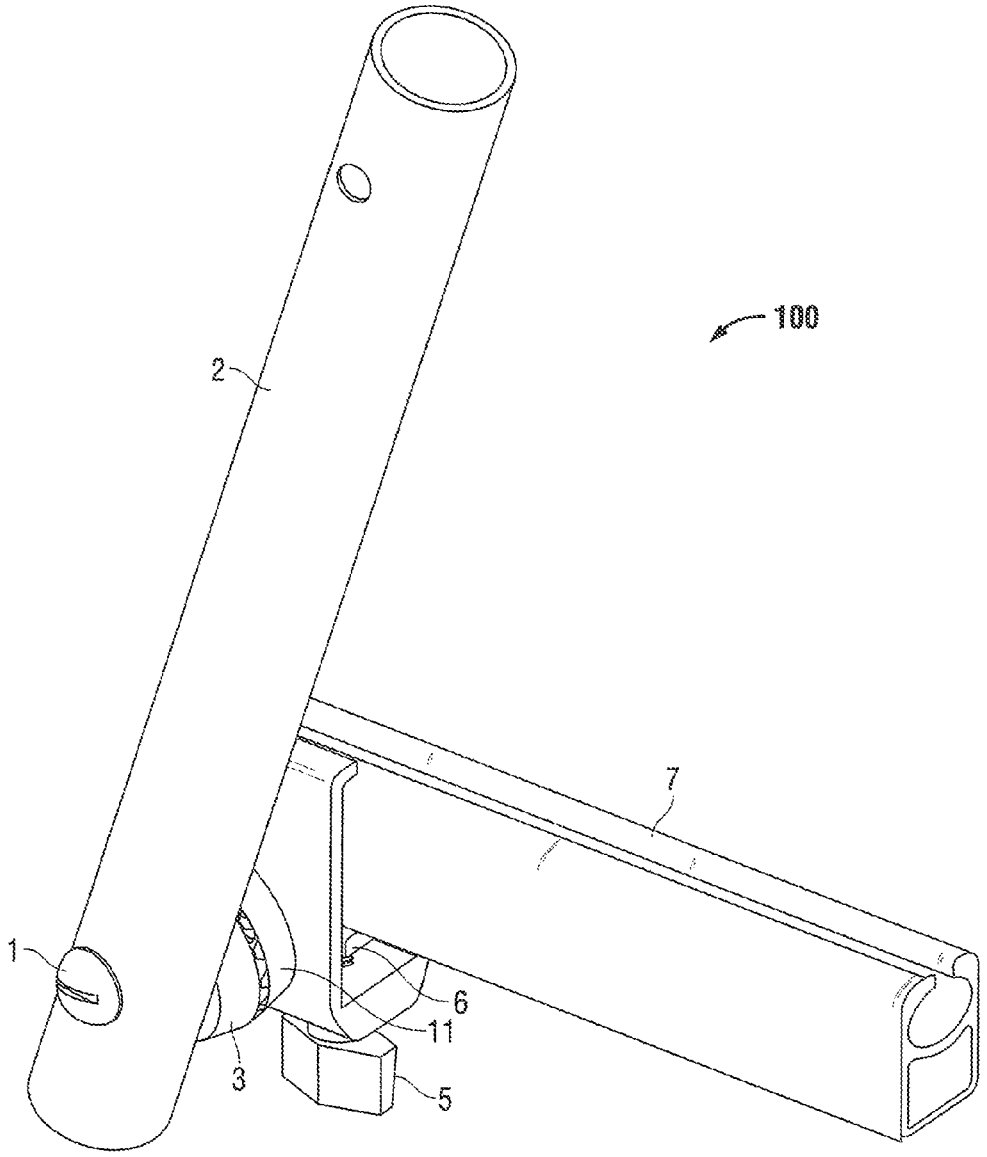
FIG. 3 is a perspective view of the first side of the canopy assembly of FIG. 1.
Figure 4:
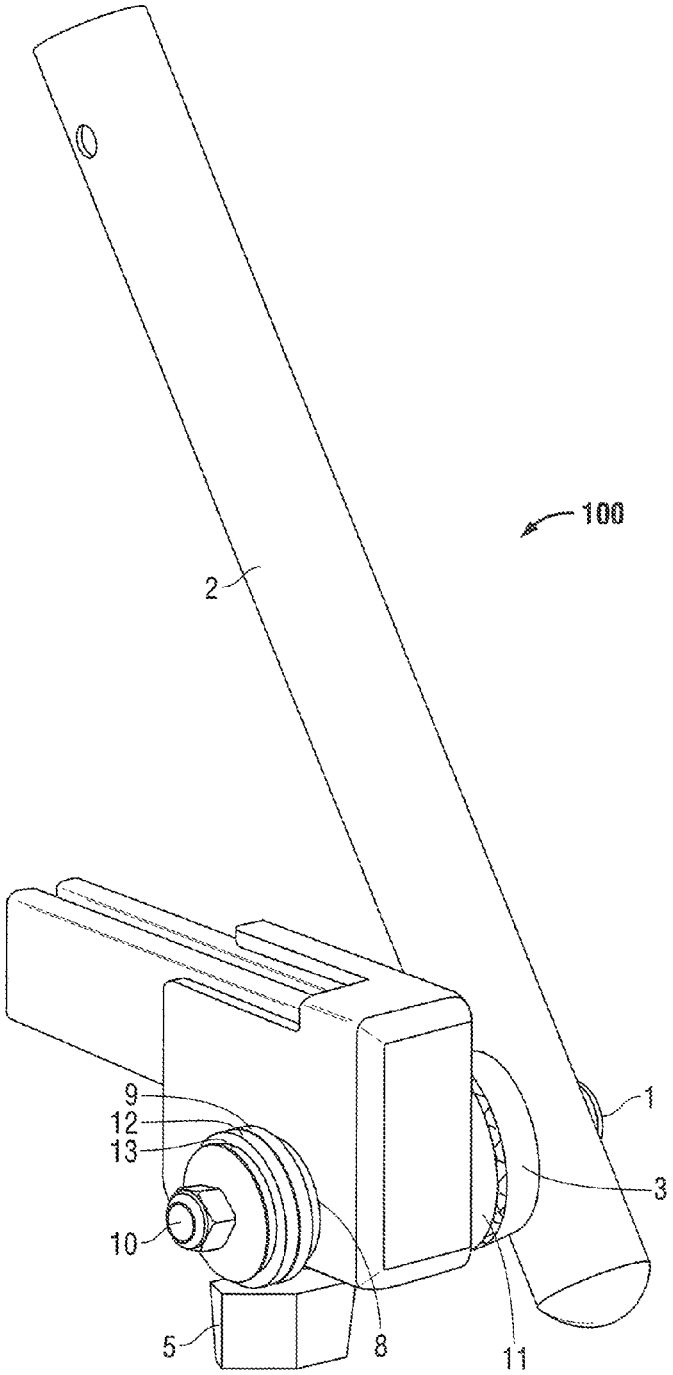
FIG. 4 is a perspective view of the second side of the canopy assembly of FIG. 2.

FIG. 3 shows a first side of the canopy assembly 100 for the right side of a chair and FIG. 4 shows the opposite second side of the canopy assembly 100.

FIG. 5 depicts the back of the left side canopy assembly 200 mounted to a chair back portion 510 of a sling-back chair. FIG. 6 depicts the front of the right side canopy assembly 100 when mounted to a chair back portion 610 of the cling-back chair.

Figure 7:
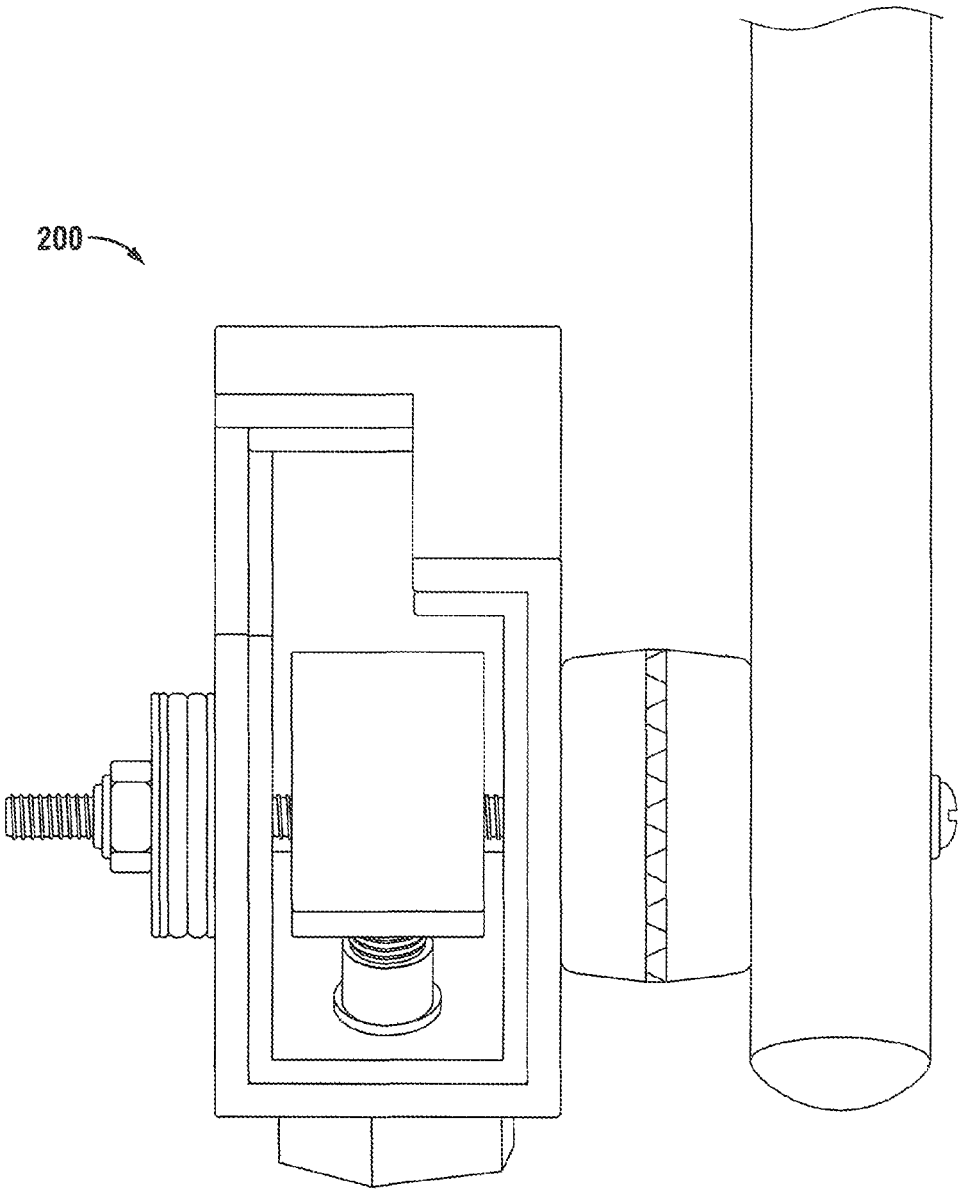
FIG. 7 is a photograph of an exemplary embodiment of a left side canopy with a view of an interior of a canopy sling rail housing.
Figure 8:
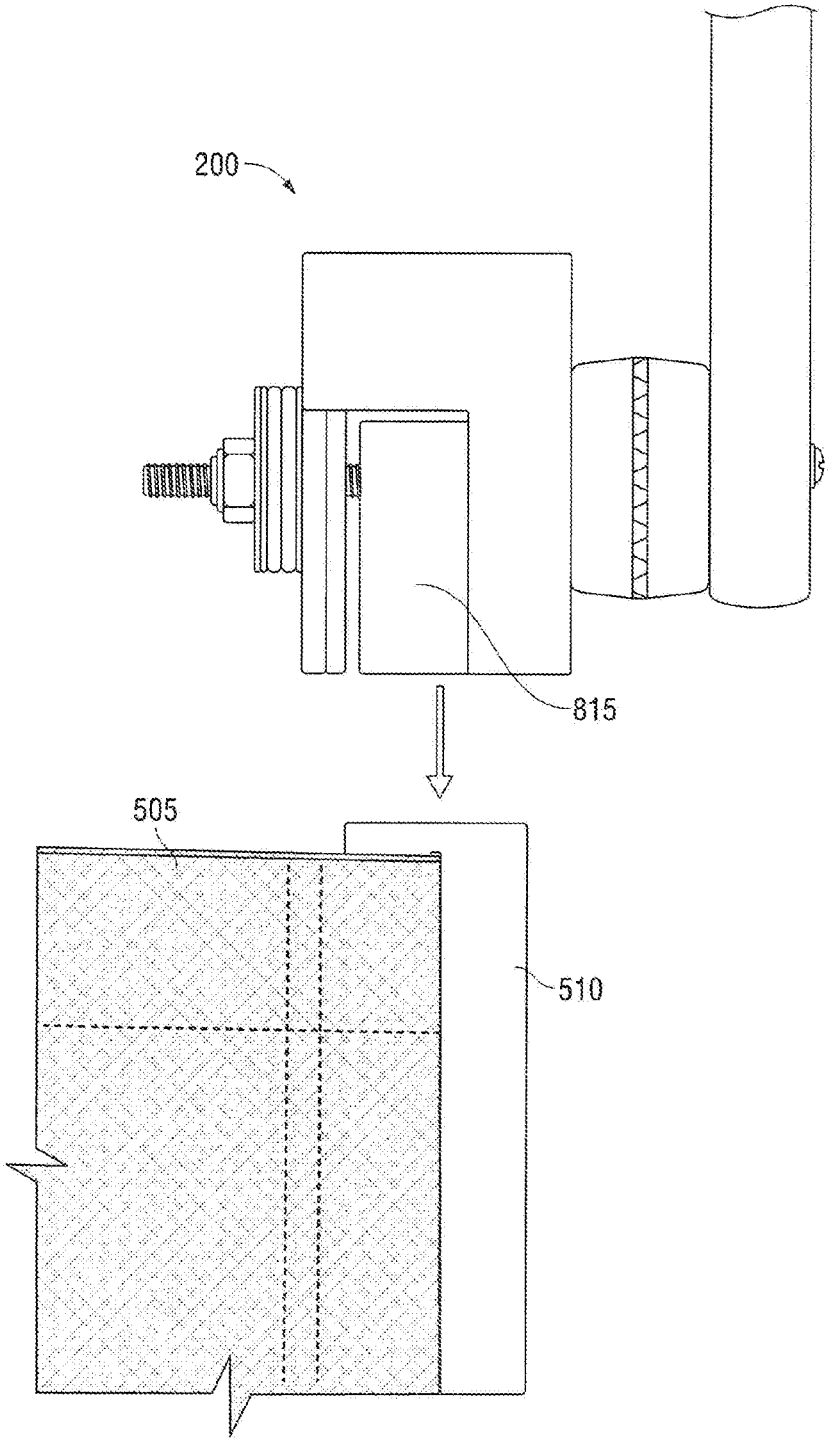
FIG. 8 is a photograph of the left side canopy of FIG. 7 rotated before installation on a sling-back chair frame.

In one exemplary embodiment, the thumb screw 5 works in conjunction with the frame lock 6 to lock sling rail 7 into place. Sling rail 7 can then be inserted into an opening of a chair back portion 510, 610. In another embodiment, the thumb screw 5 works in conjunction with the frame lock 6 to lock the canopy sling rail housing 4 in place after it has been inserted over a chair back portion 510, 610. The canopy sling rail housing 4 has an opening 815, shown best in FIG. 8, that allows the walls to slide past an upper portion 505 of the sling back of the chair back when being inserted over the chair back portion 510, 610. This installation is depicted in FIGS. 7 and 8. In particular, FIG. 7 shows the left side canopy assembly 200 with a view of the interior of the canopy sling rail housing 14 and FIG. 8 depicts how the canopy sling rail housing 14 of the left side canopy assembly 200 is able to slide over the upper portion 505 of the sling back and over the sling-chair frame portion 510 using opening 815.

Figure 9:
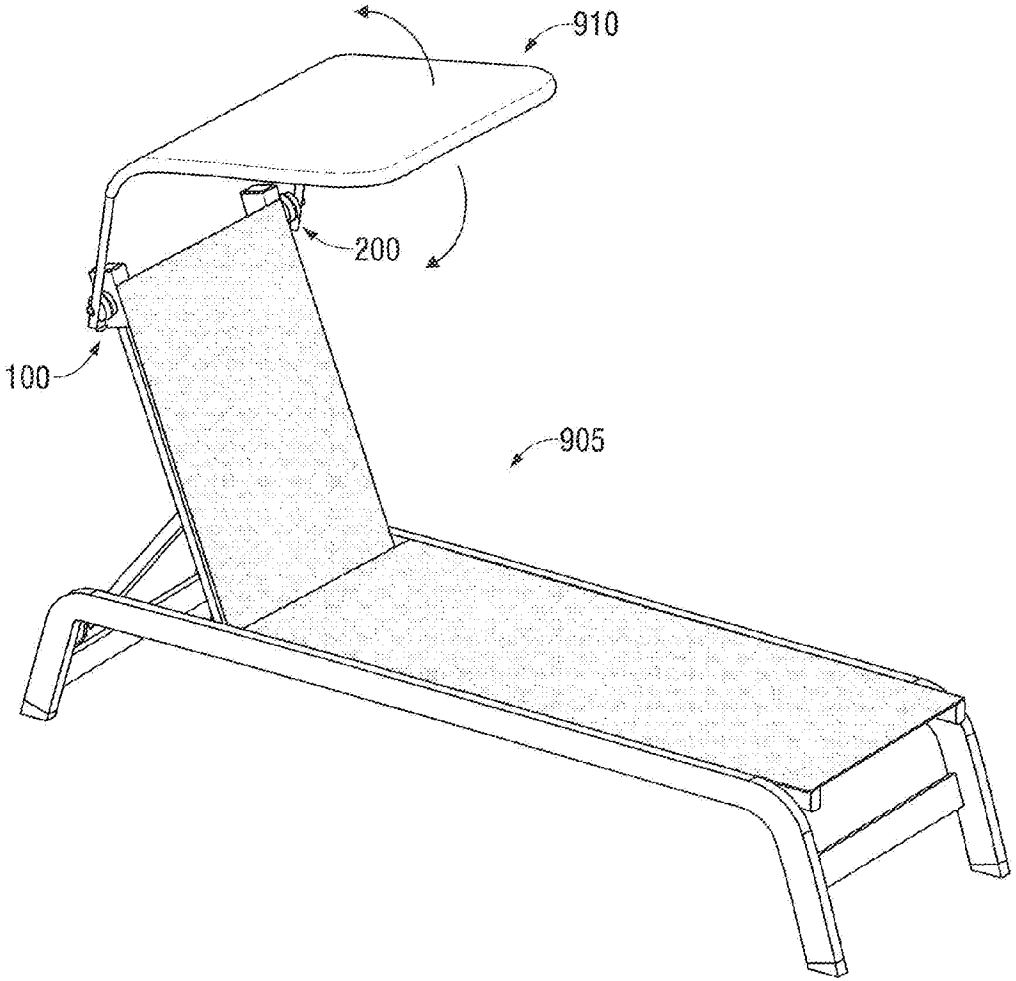
FIG. 9 is a perspective view of sling-back chaise lounge that incorporates an exemplary embodiment of canopy assemblies and a canopy.

FIG. 9 is a photograph of a sling-back type chaise lounge 905 that incorporates the canopy assemblies 100, 200 and a canopy 910.

Figure 10:
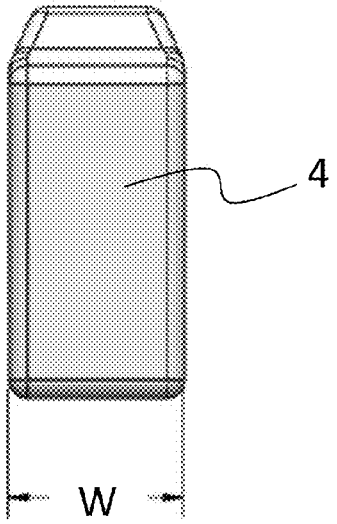
FIG. 10 is a top plan view of an exemplary embodiment of a canopy sling rail housing.

FIGS. 10 to 18 depict various views of a right side canopy sling rail housing 4. Although FIGS. 10 to 18 show a right side canopy sling rail housing 4, it should be readily apparent to those having skill in the art that a left side canopy sling rail housing 14 can be made according to the same specifications in a mirror configuration. FIG. 10 illustrates a top plan view of canopy sling rail housing 4. In one exemplary embodiment, the width W of the canopy sling rail housing 4 is 28.45 mm.

Figure 11:
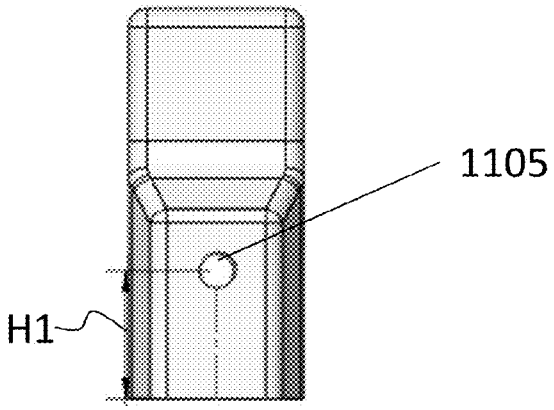
FIG. 11 is a rear elevational view of the canopy sling rail housing of FIG. 10.

FIG. 11 illustrates a rear view of canopy sling rail housing 4. This view shows a screw hole 1105 for the thumb screw 5. In one exemplary embodiment, a height H1 from a bottom of canopy sling rail housing 4 to a center of the screw hole 1105 is 20.78 mm.

Figure 12:
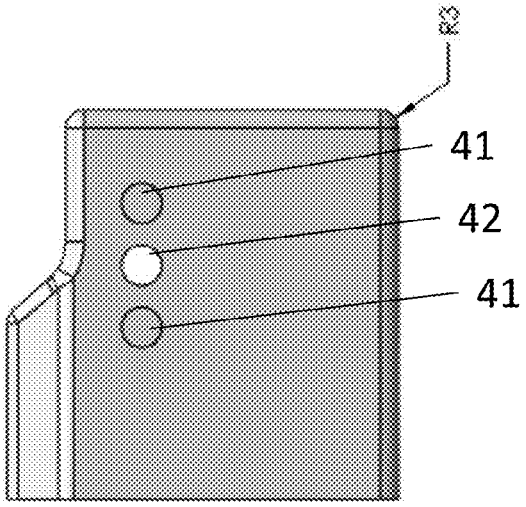
FIG. 12 is a right side elevational view of the canopy sling rail housing of FIG. 10.

FIG. 12 is a side view of canopy sling rail housing 4. This view shows two recesses or holes 41 that accommodate protrusions 31, 33 on back surfaces of each part of the canopy ratchet 3, 11. This view also shows a through hole 42, which accommodates the screw 1.

Figure 13:
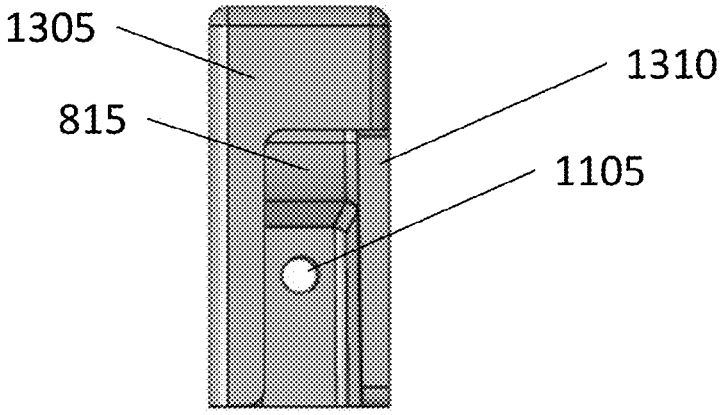
FIG. 13 is a front elevational view of the canopy sling rail housing of FIG. 10.

FIG. 13 is a front view of the canopy sling rail housing 4 and reveals the space or opening 815 and the screw hole 1105. Also shown are front facing portions 1305, 1310.

Figure 14:
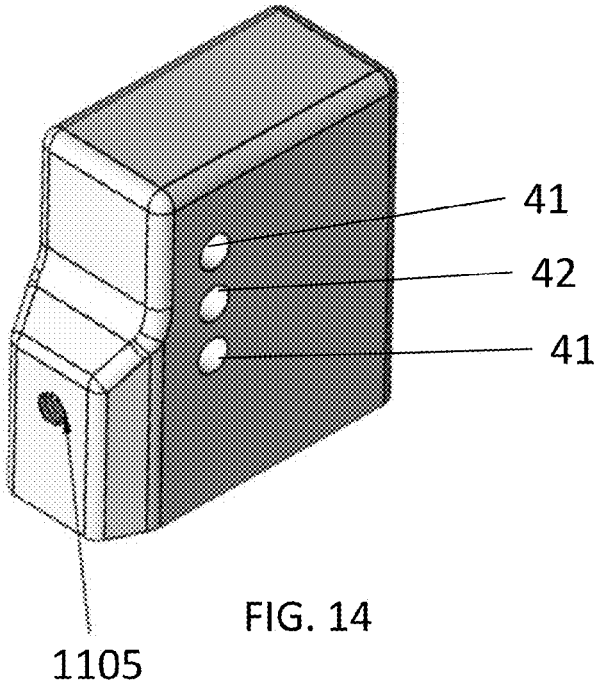
FIG. 14 is a perspective view of the canopy sling rail housing of FIG. 10 from above the rear side.

FIG. 14 is a perspective view of canopy sling rail housing 4. This view shows the recesses or holes 41, the through hole 42, and screw hole 1105. The size of the screw hole 1105 in an exemplary embodiment is a ¼-20 sized thread.

Figure 15:
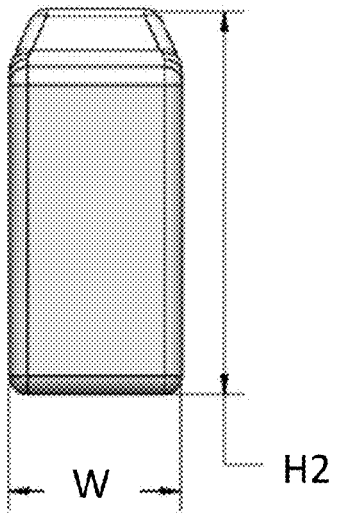
FIG. 15 is a top plan view of the canopy sling rail housing of FIG. 10.

FIG. 15 is a top plan view of canopy sling rail housing 4. This view shows the width and the overall height H2, which in an exemplary embodiment is 63.52 mm.

Figure 16:
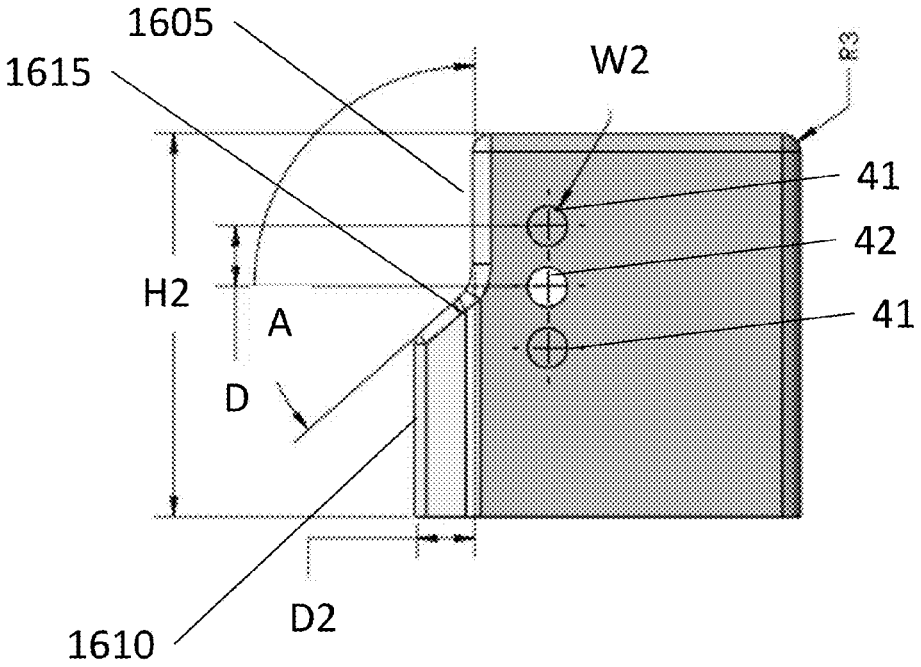
FIG. 16 is a right side elevational view of the canopy sling rail housing of FIG. 10.

FIG. 16 is a first side view of canopy sling rail housing 4. This view shows the recesses or holes 41 and the through hole 42. In this view, some dimensions of the rear of the canopy sling rail housing 4 are shown. In an exemplary embodiment, a distance D between the recesses or holes 41 and the through hole 42 is 10.1 mm, and a width W2 of the recesses or holes 41 is 6.6 mm.

The rear of the canopy sling rail housing 4 has two vertical portions 1605, 1610 and an angled connecting portion 1615. In an exemplary embodiment, a horizontal displacement D2 from the first vertical portion 1605 to the second vertical portion 1610 (i.e., the face for the thumb screw 5 and behind which is the frame lock 6) is 9.5 mm. The vertical portion 1605 and the angled connecting portion 1615 are positioned relative to each other at an angle A, which, in an exemplary embodiment, is 130 degrees.

Figure 17:
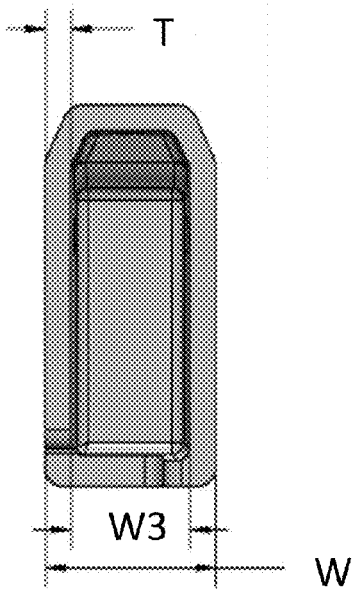
FIG. 17 is a bottom plan view of the canopy sling rail housing of FIG. 10.

FIG. 17 is a bottom plan view of canopy sling rail housing 4. In this view, a thickness T of each side of the canopy sling rail housing 4 is shown and, for example, is 4.32 mm. A width W3 of the interior space can be, for example, 19.81 mm.

Figure 18:
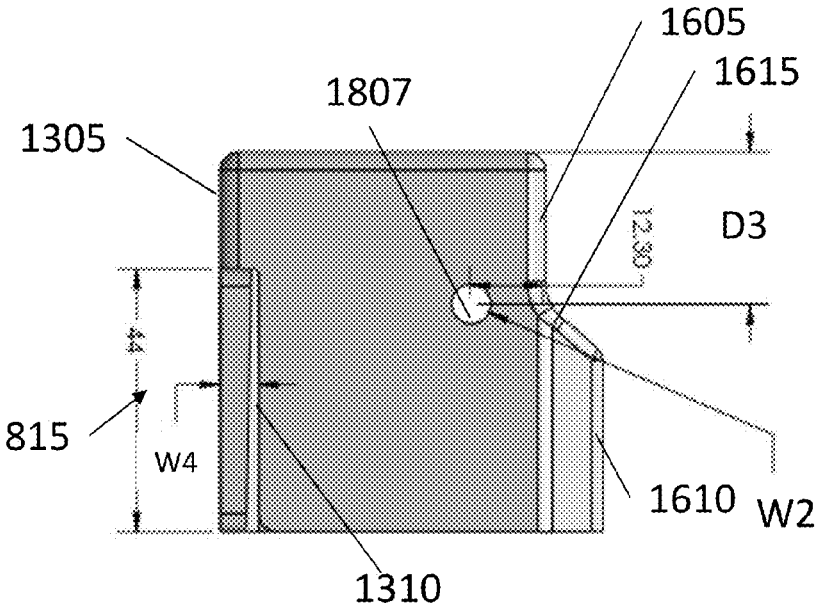
FIG. 18 is a left side elevational view of the canopy sling rail housing of FIG. 10.

FIG. 18 is an opposing second side view of canopy sling rail housing 4 to the side shown in FIG. 16. This view shows the correspondingly opposite through hole 42 to the through hole 42 shown in FIG. 16. As before, in the exemplary embodiment, a diameter of the through hole 42 is 6.60 mm. Also shown are the vertical portions 1605, 1610, the angled connecting portion 1615, and front facing portions 1305, 1310. In an exemplary embodiment, a height of the opening 815 is 44 mm, a horizontal displacement W4 between the front facing portion 1305 and the front facing portion 1310 is 6.35 mm, a distance D3 from the center of the through hole 42 to the top of the vertical portion 1605 is 24.40 mm, and a distance D4 from the center of the through hole 1807 to the face of the vertical portion 1310 is 12.30 mm.

Figure 19:
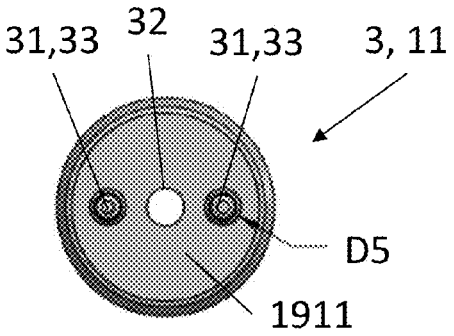
FIG. 19 is a bottom plan view of an exemplary embodiment of a canopy ratchet.

FIGS. 19 to 24 show various views of the canopy ratchet 3, 11. FIG. 19 is a bottom view of one of the canopy ratchet parts 3, 11 and shows two protrusions 31, 33. A through hole 32 for the screw 1 is also shown. In one exemplary embodiment, the protrusions 31, 33 have a diameter D5 of 6.30 mm. As shown in FIGS. 1 and 2, the protrusions 31, 33 on one part of the canopy ratchet 3, 11 fit into a respective set of recesses or holes in the canopy frame 2 and on the other part of the canopy ratchet 11, 3 fit into a respective set of recesses or holes 41 in the canopy sling rail housing 4, 14.

Figure 20:
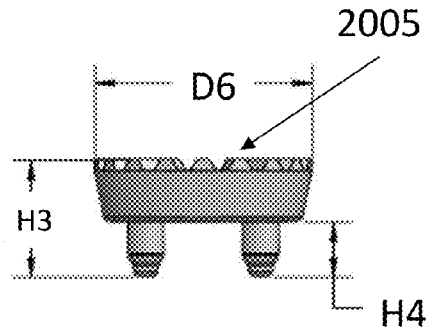
FIG. 20 is a side elevational view of the canopy ratchet of FIG. 19.

FIG. 20 is a side plan view of one part of the canopy ratchet 3, 11. A plurality of radial ridges 2005 is shown on a first surface of the canopy ratchet 3, 11 opposite the protrusions 31, 33. In an exemplary embodiment, a diameter D6 of the first surface of the canopy ratchet is 37.45 mm, a height H3 of the canopy ratchet measured from a top surface of the radial ridges 2005 to a bottom surface of the protrusions 31, 33 is 20.20 mm, and a height H4 of the protrusions as measured from the second surface of the canopy ratchet 3, 11 to the furthest extent of the protrusions 31, 33 is 9.50 mm.

Figure 21:
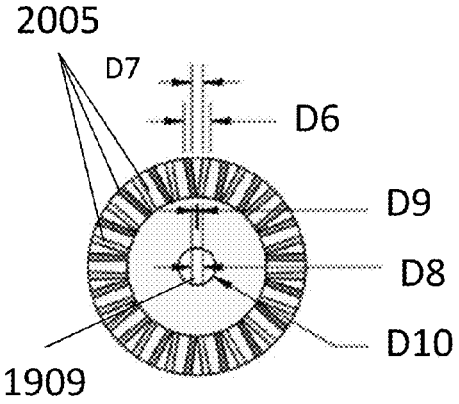
FIG. 21 is a top plan view of the canopy ratchet of FIG. 19.

FIG. 21 is a top plan view of the canopy ratchet 3, 11. The plurality of radial ridges 2005 are also shown in this figure. In an exemplary embodiment, a distance D6 between a top portion of one ridge to the top portion of an adjacent ridge of the plurality of ridges 2005 on an outer portion of the canopy ratchet 3, 11 is 4.6 mm, a distance D7 between a bottom portion of one ridge to the bottom portion of an adjacent ridge of the plurality of ridges 2005 on an outer portion of the canopy ratchet 3, 11 is 2 mm, a distance D8 between a top portion of one ridge to the top portion of an adjacent ridge of the plurality of ridges 2005 on an inner portion of the canopy ratchet 3, 11 is 2 mm, a distance D9 between a bottom portion of one ridge to a bottom portion of an adjacent ridge of the plurality of ridges 2005 on an inner portion of the canopy ratchet 3, 11 is 0.25 mm, and a diameter D10 of the through hole 32 is 6.5 mm.

Figure 22:
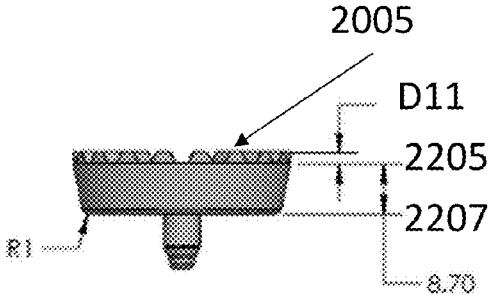
FIG. 22 is a side elevational view of the canopy ratchet of FIG. 20 rotated ninety degrees.
Figure 23:
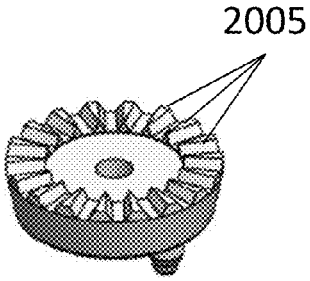
FIG. 23 is a top perspective view of the canopy ratchet of FIG. 19 showing a plurality of radial ridges in accordance with one exemplary embodiment.
Figure 24:
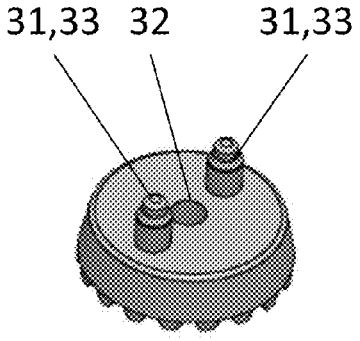
FIG. 24 is a bottom perspective view of the canopy ratchet of FIG. 19 showing protrusions in accordance with one exemplary embodiment.
Figure 25:
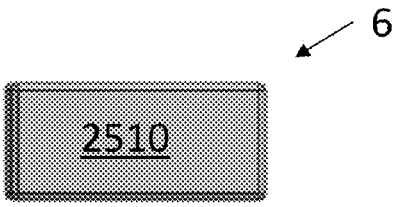
FIG. 25 is an action face side elevational view of an exemplary embodiment of a frame lock.

FIG. 22 is a side elevational view of the canopy ratchet 3, 11. The plurality of radial ridges 2005 are shown in this figure. In an exemplary embodiment, a distance D11 between the first surface of the canopy ratchet and the top surface of the plurality of radial ridges is 2 mm, and a distance D12 between the first surface 2205 and the second surface 2207 is 8.70 mm. FIG. 23 is a perspective view of the canopy ratchet 3, 11 and reveals the details of the plurality of radial ridges. FIG. 24 is a perspective view of the canopy ratchet 3, 11 opposite the view of FIG. 23 and shows the protrusions 31, 33 and the through hole 32.

Referring back to FIGS. 5 and 6, when the canopy assemblies 100, 200 are assembled, the first surfaces of canopy ratchets 3, 11 face each other and the ridges of one canopy ratchet, e.g., canopy ratchet 3, fits into the spaces between ridges, e.g., trenches, in the other second canopy ratchet, e.g., canopy ratchet 11, and vice versa. This is meant to be a tight, rigid fit that requires the use of a radial force to rotate the plurality of ridges such that one ridge moves to an adjacent trench. To allow for radial adjustment using the required radial force, the flexible washers 9, 12 are used and the canopy ratchet 3, 11 is made of a material that allows such movement without breaking. Because these washers 9, 12 are flexible, movement in a longitudinal direction of the screw 1 becomes possible. This longitudinal movement along the axis of the screw 1 allows the canopy ratchets 3, 11 to be displaced from each other along the longitudinal axis of the screw 1 so that radial adjustment of the two canopy ratchet parts 3, 11 can be accomplished, which radial adjustment allows the user to lift and lower the canopy 9 into various discrete positions as shown by the arrows in FIG. 9.

Figure 26:
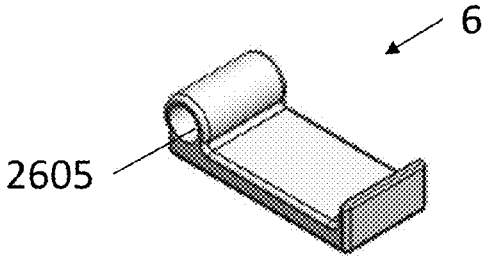
FIG. 26 is a perspective view from behind the action face of the frame lock of FIG. 25.

FIGS. 25 to 30 show various views of the frame lock 6. FIG. 26, in particular, shows a through hole 2605 that is positioned, when the frame lock 6 is disposed within a respective one of the canopy sling rail housings 4, 14, to suspend the frame lock so that the thumb screw 5 can be used to press against the action face 2510 and compress the frame lock 6 against the chair back portion 510, 610 and, thereby, lock the canopy sling rail housing 4, 14 into place on the chair.

Figure 27:
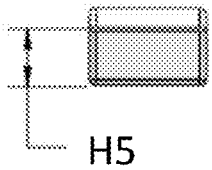
FIG. 27 is a top plan view of the frame lock of FIG. 25.
Figure 28:
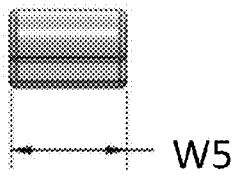
FIG. 28 is a bottom plan view of the frame lock of FIG. 25.
Figure 29:
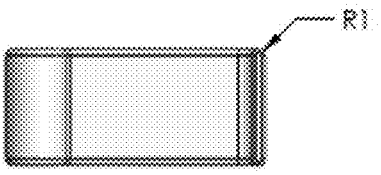
FIG. 29 is a rear elevational view of the frame lock of FIG. 25.
Figure 30:
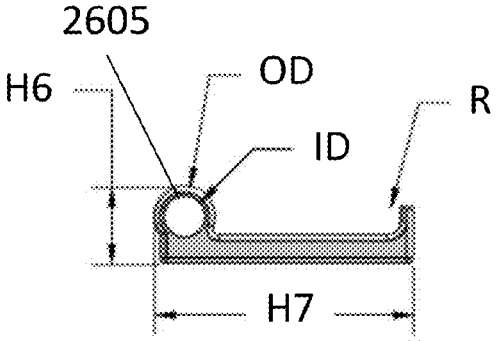
FIG. 30 is a side elevational view of the frame lock of FIG. 25.
Figure 31:
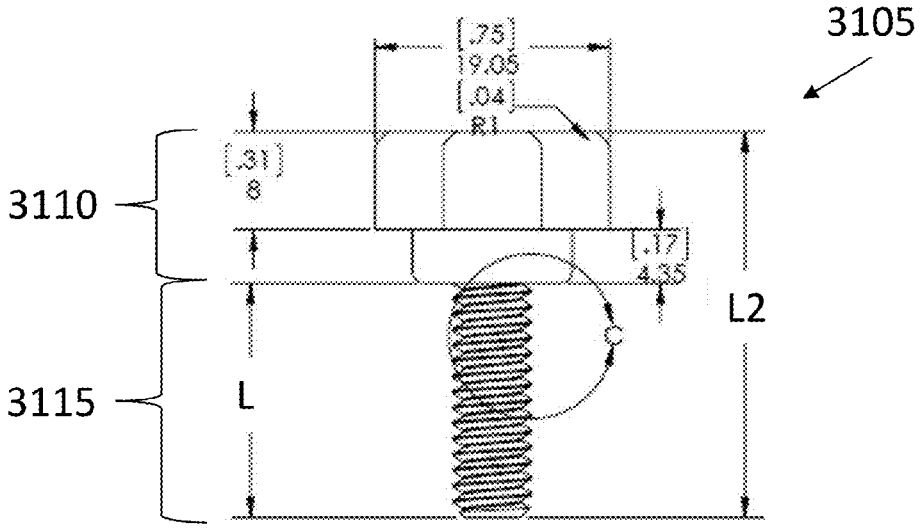
FIG. 31 is a side elevational view of a thumb screw.

In FIG. 27, a bottom view of the frame lock 6 reveals a measurement of a height H5 of the frame lock's 6 top surface. In an exemplary embodiment, the width H5 is 9.53 mm. FIG. 28 is the opposite view of the frame lock 6 in FIG. 27, in which a width W5 of the top surface of the frame lock 6 is 19.05 mm. In the side view of FIG. 30, various dimensions are shown. For example, a height H6 of the pivot portion of the frame lock 6 is 12.78 mm, an outer diameter OD of the circular part of the pivot portion surrounding the through hole 2605 is 10 mm, an inner diameter ID of the through hole 2605 is 6.85 mm, an overall height H7 of the frame lock 6 is 42.72 mm, and an inner radius of a curvature R at the top of frame lock 6 is 2.38 mm.

Figure 32:
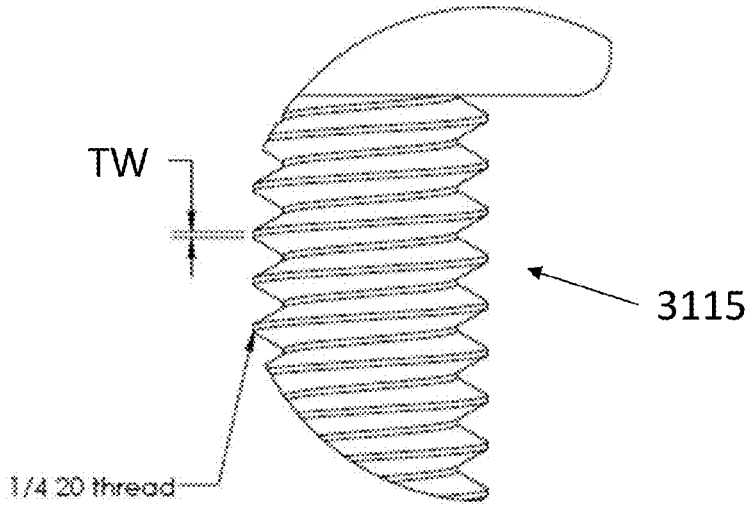
FIG. 32 is a fragmentary, enlarged, side elevational view of a threaded portion of the thumb screw within circle C in FIG. 31.
Figure 33:
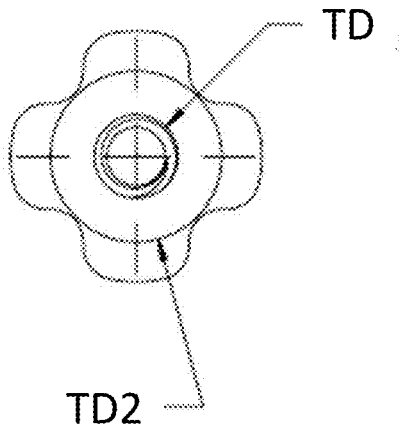
FIG. 33 is a bottom plan view of the thumb screw of FIG. 31.
Figure 34:
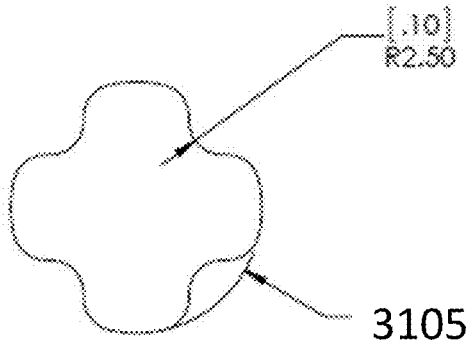
FIG. 34 is a top plan view of the thumb screw of FIG. 31.

FIGS. 31 to 34 show various views of one exemplary embodiment of a thumb screw 3105. Any kind of similarly functioning device can take the place of the thumb screw embodiment shown and described. In the side view of FIG. 31, the thumb screw 3105 has a top portion 3110 and a threaded portion 3115, which is to be threaded into the threaded through hole 1105 for engagement and moving of the frame lock 6. Although the thumb screw 3105 shown in FIGS. 31 to 34 is different than, for example, the thumb screw 5 shown in FIGS. 1 and 2, the outer thread of whatever device is used (e.g., thumb screw 5, 3105) must match the thread size of the screw hole 1105 of canopy sling rail housing 4, 14. In an exemplary embodiment, a length L of the threaded portion 3115 is 19.05 mm and an overall length L2 of both the top portion 3110 and the threaded portion is 31.40 mm. In the enlarged view of FIG. 32 showing the threaded portion 3115 various dimensions can be seen. For example, a thread width TW can be 0.16 mm and the thread can be ¼-20. The bottom view of FIG. 33 shows features of the threaded portion 3115. In an exemplary embodiment, the threaded portion 3115 has a diameter TD of 6.35 mm (¼") and a bottom surface of the top portion 3110 has a diameter TD2 of 13 mm. FIG. 34 is a top plan view of thumb screw 3105. It is noted that various individual features of the inventive processes and systems may be described only in one exemplary embodiment herein. The particular choice for description herein with regard to a single exemplary embodiment is not to be taken as a limitation that the particular feature is only applicable to the embodiment in which it is described. All features described herein are equally applicable to, additive, or interchangeable with any or all of the other exemplary embodiments described herein and in any combination or grouping or arrangement. In particular, use of a single reference numeral herein to illustrate, define, or describe a particular feature does not mean that the feature cannot be associated or equated to another feature in another drawing figure or description. Further, where two or more reference numerals are used in the figures or in the drawings, this should not be construed as being limited to only those embodiments or features, they are equally applicable to similar features or not a reference numeral is used or another reference numeral is omitted.

The foregoing description and accompanying drawings illustrate the principles, exemplary embodiments, and modes of operation of the systems and methods. However, the systems and methods should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the systems and methods as defined by the following claims.

What is claimed is:

1. A retrofitting canopy assembly, comprising:

a canopy sling rail housing defining:

at least one housing orifice;

an interior; and first and second openings communicating from the interior to the environment and, together, are shaped to receive a top portion of a sling-back-type chair frame when the canopy sling rail housing is slid thereon to place the top portion within the interior;

a plurality of washers;

a canopy frame having a connection section and a shade canopy, the connection section defining at least one first orifice;

a first canopy ratchet part having at least one projection that, when inserted into the at least one first orifice, rotationally fixes the first canopy ratchet part to the connection section of the canopy frame;

a second canopy ratchet part having at least one projection that, when inserted into the at least one housing orifice, rotationally fixes the second canopy ratchet part to the canopy sling rail housing;

a frame lock positioned within the interior of the canopy sling rail housing and movable to selectively press against the top portion of the sling-back-type chair frame when the canopy sling rail housing is installed thereon; and a fastener securing the connection section of the canopy frame to the first canopy ratchet part, the second canopy ratchet part, the canopy sling rail housing, the frame lock, and the plurality of washers such that, when the canopy sling rail housing is placed on the top portion of the sling-back-type chair frame, the first and second canopy ratchet parts remain rotationally fixed to one other to keep the shade canopy in a given position until a given force sufficient to overcome the ratchet is applied to at least one of the canopy frame and the shade canopy.

2. The canopy assembly according to claim 1, wherein:

the canopy sling rail housing, the plurality of washers, the first and second canopy ratchet parts, the frame lock, and the fastener is a first housing sub-assembly and further comprising a second housing sub-assembly that is a mirror image of the first housing sub-assembly; and the two housing sub-assemblies respectively fit over opposing top portions of the sling-back-type chair frame to place the shade canopy over the sling-back-type chair and provide shade to a user in an adjustable manner.

3. The canopy assembly according to claim 1, wherein the fastener removably secures the connection section of the canopy frame to the first canopy ratchet part, the second canopy ratchet part, the canopy sling rail housing, the frame lock, and the plurality of washers.

4. The canopy assembly according to claim 3, wherein:

the connection section of canopy frame has a transverse opening;

the first and second canopy ratchet parts have a coaxial central openings;

the canopy sling rail housing has a transverse opening pair;

the frame lock has a transverse opening;

the plurality of washers each have a coaxial central opening; and the fastener is a single screw passing through, in order, the transverse opening, the coaxial central openings, a first of the transverse opening pair, the transverse opening, the second of the transverse opening pair, and the coaxial central openings, and the canopy frame, the first and second ratchet parts, the canopy sling rail housing, the frame lock, and the washers are fastened together with a locking nut to permit the first and second canopy ratchet parts to remain rotationally fixed to one other and keep the shade canopy in a given position until a given force sufficient to overcome the ratchet is applied to at least one of the canopy frame and the shade canopy.

5. The canopy assembly according to claim 1, further comprising a thumb screw cooperating with the canopy sling rail housing to selectively move the frame lock towards and away from the top portion of the sling-back-type chair frame when the canopy sling rail housing is installed thereon.

6. The canopy assembly according to claim 5, wherein the frame lock and the thumb screw removably secure the canopy sling rail housing to the top portion of the sling-back-type chair frame.

7. A retrofitting canopy assembly, comprising:

a canopy sling rail housing defining:

at least one housing orifice;

an interior; and first and second openings communicating from the interior to the environment and, together, are shaped to receive a top portion of a sling-back-type chair frame when the canopy sling rail housing is slid thereon to place the top portion within the interior;

a plurality of washers;

a canopy frame having a connection section and a shade canopy, the connection section defining at least one first orifice;

a first canopy ratchet part:

having a plurality of first circumferentially spaced ridges defining a plurality of first trenches between each adjacent pair of the plurality of first circumferentially spaced ridges;

having at least one projection that, when inserted into the at least one first orifice, rotationally fixes the first canopy ratchet part to the connection section of the canopy frame; and being rotationally fixed to the connection section of the canopy frame;

a second canopy ratchet part:

having a plurality of second circumferentially spaced ridges defining a plurality of second trenches between each adjacent pair of the plurality of second circumferentially spaced ridges;

having at least one projection that, when inserted into the at least one housing orifice, rotationally fixes the second canopy ratchet part to the canopy sling rail housing; and being rotationally fixed to the canopy sling rail housing;

a frame lock positioned within the interior of the canopy sling rail housing and movable to selectively press against the top portion of the sling-back-type chair frame when the canopy sling rail housing is installed thereon; and a fastener securing the connection section of the canopy frame to the first canopy ratchet part, the second canopy ratchet part, the canopy sling rail housing, the frame lock, and the plurality of washers such that, when the canopy sling rail housing is placed on the top portion of the sling-back-type chair frame, the first and second canopy ratchet parts remain rotationally fixed to one other to keep the shade canopy in a given position until a given force sufficient to overcome the ratchet is applied to at least one of the canopy frame and the shade canopy.

8. The canopy assembly according to claim 7, wherein the second circumferentially spaced ridges are a mirror image of the first circumferentially spaced ridges such that, when the first and second circumferentially spaced ridges are meshed together, a ratchet assembly is formed.

9. The canopy assembly according to claim 7, wherein:

the plurality of first circumferentially spaced ridges are shaped to fit into the plurality of second trenches;

the plurality of second circumferentially spaced ridges are shaped fit into the plurality of first trenches; and when the first and second circumferentially spaced ridges are fit into the respective first and second trenches, the first and second canopy ratchet parts together form a ratchet assembly.

10. The canopy assembly according to claim 7, wherein the plurality of washers comprise a pair of non-elastic washers sandwiching therebetween a pair of elastic washers.

11. The canopy assembly according to claim 10, wherein:

the fastener has a longitudinal axis;

the plurality of washers together permit displacement along the longitudinal axis of the fastener; and radial adjustment of the first and second ratchet parts is accomplished by rotating the plurality of first radial ridges and second radial ridges to an adjacent trench with the displacement of the washers along the longitudinal axis.

12. A retrofitting canopy assembly, comprising:

a canopy frame having a first connection section, a second connection section, and a shade canopy, the first connection section defining at least one first orifice, the second connection section defining at least one third orifice;

a first housing sub-assembly comprising:

a first canopy sling rail housing defining:

at least one second orifice;

a first housing interior; and first and second openings communicating from the first housing interior to the environment and, together, are shaped to receive a top left portion of a sling-back-type chair frame when the first canopy sling rail housing is slid thereon to place the top left portion within the first housing interior;

a first plurality of washers;

a first canopy ratchet part rotationally fixed to the first connection section of the canopy frame and having at least one projection that, when inserted into the at least one first orifice, rotationally fixes the first canopy ratchet part to the first connection section of the canopy frame;

a second canopy ratchet part rotationally fixed to the first canopy sling rail housing and having at least one projection that, when inserted into the at least one second orifice, rotationally fixes the second canopy ratchet part to the first canopy sling rail housing;

a first frame lock positioned within the first housing interior and movable to selectively press against the top left portion of the sling-back-type chair frame when the first canopy sling rail housing is installed thereon; and a first fastener securing the first connection section of the canopy frame to the first canopy ratchet part, the second canopy ratchet part, the first canopy sling rail housing, the first frame lock, and the first plurality of washers such that, when the first canopy sling rail housing is placed on the top left portion of the sling-back-type chair frame, the first and second canopy ratchet parts remain rotationally fixed to one other to keep the shade canopy in a given position until a given force sufficient to overcome the ratchet is applied to at least one of the canopy frame and the shade canopy; and a second housing sub-assembly comprising:

a second canopy sling rail housing defining:

at least one fourth orifice;

a second housing interior; and third and fourth openings communicating from the second housing interior to the environment and, together, are shaped to receive a top right portion of a sling-back-type chair frame when the second canopy sling rail housing is slid thereon to place the top right portion within the second housing interior;

a second plurality of washers;

a third canopy ratchet part rotationally fixed to the second connection section of the canopy frame and having at least one projection that, when inserted into the at least one third orifice, rotationally fixes the third canopy ratchet part to the second connection section of the canopy frame;

a fourth canopy ratchet part rotationally fixed to the second canopy sling rail housing and having at least one projection that, when inserted into the at least one fourth orifice, rotationally fixes the fourth canopy ratchet part to the second canopy sling rail housing;

a second frame lock positioned within the second housing interior and movable to selectively press against the top right portion of the sling-back-type chair frame when the second canopy sling rail housing is installed thereon; and a second fastener securing the second connection section of the canopy frame to the third canopy ratchet part, the fourth canopy ratchet part, the second canopy sling rail housing, the second frame lock, and the second plurality of washers such that, when the second canopy sling rail housing is placed on the top right portion of the sling-back-type chair frame, the third and fourth canopy ratchet parts remain rotationally fixed to one other to keep the shade canopy in a given position until a given force sufficient to overcome the ratchet is applied to at least one of the canopy frame and the shade canopy.

13. The canopy assembly according to claim 12, further comprising thumb screws each respectively cooperating with one of the first and second canopy sling rail housings to selectively move the respective one of first and second frame locks towards and away from the top left or right portions of the sling-back-type chair frame when the first and second canopy sling rail housings are installed thereon.

14. The canopy assembly according to claim 13, wherein each respective pair of the frame locks and the thumb screws removably secure one of the first and second canopy sling rail housings to one of the top left or right portions of the sling-back-type chair frame.

15. The canopy assembly according to claim 12, wherein:

the first canopy ratchet part has a plurality of first circumferentially spaced ridges defining a plurality of first trenches between each adjacent pair of the plurality of first circumferentially spaced ridges;

the second canopy ratchet part has a plurality of second circumferentially spaced ridges defining a plurality of second trenches between each adjacent pair of the plurality of second circumferentially spaced ridges;

the third canopy ratchet part has a plurality of third circumferentially spaced ridges defining a plurality of third trenches between each adjacent pair of the plurality of third circumferentially spaced ridges; and the fourth canopy ratchet part has a plurality of fourth circumferentially spaced ridges defining a plurality of fourth trenches between each adjacent pair of the plurality of fourth circumferentially spaced ridges.

16. The canopy assembly according to claim 15, wherein:

the second circumferentially spaced ridges are a mirror image of the first circumferentially spaced ridges such that, when the first and second circumferentially spaced ridges are meshed together, a ratchet assembly is formed; and the fourth circumferentially spaced ridges are a mirror image of the third circumferentially spaced ridges such that, when the third and fourth circumferentially spaced ridges are meshed together, a ratchet assembly is formed.

17. The canopy assembly according to claim 15, wherein:

the plurality of first circumferentially spaced ridges are shaped to fit into the plurality of second trenches;

the plurality of second circumferentially spaced ridges are shaped fit into the plurality of first trenches;

the plurality of third circumferentially spaced ridges are shaped to fit into the plurality of fourth trenches;

the plurality of fourth circumferentially spaced ridges are shaped fit into the plurality of third trenches; and when the third and fourth circumferentially spaced ridges are fit into the respective third and fourth trenches, the third and fourth canopy ratchet parts together form a ratchet assembly.

18. The canopy assembly according to claim 15, wherein:

the first and second plurality of washers each comprise a pair of non-elastic washers sandwiching therebetween a pair of elastic washers;

each of the first and second fasteners has a longitudinal axis;

the sets of the first and second plurality of washers each permit displacement along the longitudinal axis of the respective first and second fasteners; and radial adjustment of the first and second ratchet parts and the third and fourth ratchet parts is accomplished by respectively rotating the plurality of first radial ridges and second radial ridges to an adjacent trench with the displacement of the washers along the longitudinal axis and rotating the plurality of third radial ridges and fourth radial ridges to an adjacent trench with the displacement of the sets of washers along the longitudinal axis.

* * * * *